US008870521B2

(12) United States Patent
Brecht et al.

(10) Patent No.: US 8,870,521 B2
(45) Date of Patent: Oct. 28, 2014

(54) SEALING SYSTEM FOR CENTRIFUGAL PUMPS

(75) Inventors: Bernhard Brecht, Neustadt (DE); Uwe Bruhns, Gruenstadt (DE); Frank Sehr, Birkenheide (DE)

(73) Assignee: KSB Aktiengesellschaft, Frankenthal (DE)

( * ) Notice: Subject to any disclaimer, the term of this patent is extended or adjusted under 35 U.S.C. 154(b) by 0 days.

(21) Appl. No.: 13/310,540

(22) Filed: Dec. 2, 2011

(65) Prior Publication Data

US 2012/0076643 A1 Mar. 29, 2012

Related U.S. Application Data

(63) Continuation of application No. PCT/EP2010/003210, filed on May 26, 2010.

(30) Foreign Application Priority Data

Jun. 4, 2009 (DE) ..... 10 2009 023 907

(51) Int. Cl.

| | |
|---|---|
| ***F01D 11/00*** | (2006.01) |
| ***F01D 25/16*** | (2006.01) |
| ***F04D 29/08*** | (2006.01) |
| ***F01D 3/00*** | (2006.01) |
| ***F01D 3/04*** | (2006.01) |
| ***F01D 5/02*** | (2006.01) |
| ***F04D 29/041*** | (2006.01) |
| ***F04D 27/02*** | (2006.01) |
| ***F04D 29/12*** | (2006.01) |
| ***F04D 29/58*** | (2006.01) |

(52) U.S. Cl.

CPC ..... *F04D 29/126* (2013.01); *F04D 29/041* (2013.01); *F04D 27/0215* (2013.01); *F04D 27/0207* (2013.01); *F04D 29/5893* (2013.01); *F04D 29/128* (2013.01)

USPC ..... 415/58.4; 415/104; 415/112; 415/230; 415/206; 277/370; 277/371; 277/408

(58) Field of Classification Search

CPC ... F04D 29/041; F04D 29/106; F04D 29/108; F04D 29/126; F04D 29/128; F04D 29/167; F01D 3/00

USPC ..... 415/104, 110, 111, 112, 230; 416/174; 277/358, 370–371, 408

See application file for complete search history.

(56) References Cited

U.S. PATENT DOCUMENTS 2,221,225 A 11/1940 Weis et al.
3,999,882 A * 12/1976 Purton ..... 415/112

(Continued)

FOREIGN PATENT DOCUMENTS

DE 903 535 C 2/1954
DE 29 08 733 A1 9/1980

(Continued)

OTHER PUBLICATIONS

International Search Report with partial English translation dated Sep. 16, 2010 (five (5) pages).

(Continued)

*Primary Examiner* — Ned Landrum
*Assistant Examiner* — Su Htay
(74) *Attorney, Agent, or Firm* — Crowell & Moring LLP

(57) ABSTRACT

A centrifugal pump for delivering hot fluids, having a contacting shaft seal, a seal housing (13) for the shaft seal (14), and a return line (8) for a partial flow of the delivered fluid, in which no delivered fluid is discharged out of the seal housing (13); a separate housing cover (9) is disposed between the seal housing (13) and the pump housing (1); there is a contact surface which minimizes heat transfer between the seal housing (13) and the housing cover (9); and the return line (8) is connected to the housing cover (9) and/or to the pump housing (1).

18 Claims, 2 Drawing Sheets

(56) References Cited

U.S. PATENT DOCUMENTS

| | | | | | |
|---|---|---|---|---|---|
| 4,795,167 | A | * | 1/1989 | Otsuka | 277/352 |
| 4,884,945 | A | * | 12/1989 | Boutin et al. | 415/174.2 |
| 5,624,245 | A | * | 4/1997 | DeClerck et al. | 417/373 |
| 5,795,129 | A | * | 8/1998 | Urban et al. | 415/170.1 |
| 5,911,565 | A | * | 6/1999 | Mann et al. | 417/373 |
| 6,287,074 | B1 | * | 9/2001 | Chancellor | 415/231 |
| 2008/0121384 | A1 | * | 5/2008 | Tseng | 165/149 |

FOREIGN PATENT DOCUMENTS

| | | | |
|---|---|---|---|
| DE | 42 30 715 | A1 | 3/1994 |
| DE | 195 18 564 | A1 | 11/1996 |
| EP | 0 588 259 | B1 | 3/1994 |
| GB | 2 071 211 | A | 9/1981 |

OTHER PUBLICATIONS

Form PCT/ISA/237 (six (6) pages).

* cited by examiner

SEALING SYSTEM FOR CENTRIFUGAL PUMPS

CROSS REFERENCE TO RELATED APPLICATIONS

This application is a continuation of international patent application no. PCT/EP2010/003210, filed May 26, 2010, designating the United States of America, and published in German on Dec. 9, 2010 as WO 2010/139415, the entire disclosure of which is incorporated herein by reference. Priority is claimed based on Federal Republic of Germany patent application no. DE 10 2009 023 907.3, filed Jun. 4, 2009, the entire disclosure of which is likewise incorporated herein by reference.

BACKGROUND OF THE INVENTION

The invention relates to a centrifugal pump for delivering hot fluids, having a contacting shaft seal, a seal housing for the shaft seal, and a return line for a partial flow of the delivered fluid.

A centrifugal pump of this kind is described in U.S. Pat. No. 5,795,129 (=DE 42 30 715), which is used as a feed pump for delivering hot fluids. A delivered fluid emerging from the relief device thereof forms a partial flow of the delivered fluid. This partial flow, also known as "relief water", is used to cool a mechanical seal. For this purpose, it flows completely through the seal chamber thereof and, in doing so, dissipates the frictional heat which arises during the operation of the mechanical seal. After this, the relief water is discharged from the seal chamber via a return line, which connects the seal housing to a pump stage. This type of shaft seal cooling can be used only up to a certain operating temperature of the delivered fluid.

A centrifugal pump having a sealing system for relatively high operating temperatures is described in European patent application no. EP 588,259 (=DE 195.18 564). Disposed between a seal chamber containing a mechanical seal and the interior of the pump is another sealing element, which rests against the rotating part of the pump. This sealing element is composed of a high-polymer plastic. To reduce heat input, the relief water in this design is not passed through the seal chamber. To achieve this, the sealing element shields the seal chamber from the hot delivered fluid in the interior of the pump and, at the same time, ensures pressure compensation relative to the seal chamber. The relief water is returned to the suction side of the centrifugal pump by a return line. The seal housing is integrated into a cooling circuit, the cooling fluid of which has initially been taken from the delivered fluid. Heat is removed from the cooling fluid by a separate cooling circuit connected to the seal housing. For this purpose, conventional external cooling systems can be employed.

SUMMARY OF THE INVENTION

It is the object of the present invention to make available a multi-stage centrifugal pump in which the shaft sealing system is designed for a delivered fluid in a temperature range exceeding 160° C. and which can be used for the entire temperature range of feed pumps. The invention furthermore aims to dispense with the supply of external cooling fluids to the seal chamber and to create a low-cost reliable sealing system.

According to the invention, this object is achieved by virtue of the fact that no delivered fluid is discharged from the seal housing, that a separate housing cover is disposed between the seal housing and the pump housing, there being a contact surface that minimizes heat transfer between the seal housing and the housing cover, and that the return line is connected to the housing cover and/or to the pump housing.

There is an axial gap between the housing cover and a rotating component. The rotating component can be either the shaft of the pump or a shaft protection sleeve pushed over the pump shaft. The axial gap extends parallel to the shaft and runs around the shaft. In geometrical terms, this gap is a hollow cylinder. The gap restricts the inflow of fluid delivered by the pump into the seal chamber. The narrower and longer the gap, the less relief water can enter the seal housing.

The invention is preferably used with multi-stage centrifugal pumps, where the centrifugal pump has a relief device for the axial thrust and the contacting shaft seal is disposed downstream of the relief device, relief water being discharged via the return line. When hot fluids are being delivered, the return line for the relief water represents an additional source of heat, which can have a negative effect on the shaft seal. According to the invention, the connection for a return line for the relief water has been disposed at a distance from the seal housing. In contrast to prior art devices, it is thus impossible for the heat to be released directly to the seal housing by the return line.

The novel seal housing surrounds the contacting seal. The seal is preferably a mechanical seal. Division into a housing cover and a novel seal housing ensures thermal decoupling of the seal chamber from the hot pump housing. On the one hand, this is accomplished by virtue of the fact that heat conduction between the housing cover and the seal housing is minimized. On the other hand, it is accomplished by discharging delivered fluid in the form of relief water from the pump housing at a distance from the seal housing.

In a particularly advantageous embodiment of the invention, the seal housing has a projection. This projection preferably projects in the form of an offset surrounding the shaft on the inside of the seal housing. The offset serves to center the seal housing relative to the housing cover which closes the pump housing. The area of the projection reduces the contact surfaces, which entail heat conduction, to a size that is necessary in terms of strength. The aim is to make this contact surface as small as possible in order to minimize heat conduction from the housing cover to the seal housing.

In another particularly advantageous embodiment of the invention, the housing cover also has a projection. In this case, the projection on the housing cover projects into the seal housing. The projection on the housing cover is likewise designed as a hollow cylinder which surrounds the shaft. The seal housing is pushed onto the outer lateral surface of the projection on the housing cover until the projection on the seal housing strikes the housing cover. The projection on the seal housing and the projection on the housing cover rest against one another in a manner which allows force transmission, and they can also overlap.

Heat conduction between the parts is additionally reduced if a thermally insulating seal element is disposed between the contact surface of the projection and the housing cover.

The projection can also be a single part in the form of a thermally insulating and centering connecting element that can be disposed between the seal housing and the housing cover. This gives greater flexibility in the combination of such a seal housing with different types of pump. In the context of a pump overhaul, this likewise makes it possible to retrofit older pumps and thus make them suitable for a different area of application.

In a particularly advantageous embodiment of the invention, the seal housing is composed of an inner part and an outer part. The inner part, which surrounds the contacting seal, is composed of a different material than the outer part. It has proven advantageous if the inner part is designed as a sleeve connected in a heat-conducting and force-transmitting manner to the outer part, it being possible for it to be shrunk in, for example. It is also conceivable for the outer part to be provided on the inside thereof with a protective coating, plating or the like. In this case, the coating or plating forms the inner part of the seal housing.

The outer part of the seal housing preferably has a better thermal conductivity than the inner part. As a result, the heat can be dissipated rapidly to the outside. It has proven advantageous here to design the outer part of the seal housing as a bronze body. However, other materials which have good thermal conductivity and are capable of meeting the prevailing demands on the strength thereof can be used for this purpose.

The inner part of the seal housing is preferably composed of a material which is particularly corrosion-resistant to the delivered fluid. In an advantageous embodiment of the invention, the inner part of the seal housing is formed by a stainless steel sleeve. This can be shrunk-fit into the outer part, e.g. a bronze body. The stainless steel sleeve ensures corrosion resistance. The bronze body ensures that the heat is dissipated from the seal chamber to the environment of the pump to a sufficient degree.

In a particularly advantageous embodiment of the invention, the projection of the seal housing is formed by the inner part of the seal housing. Only the projection has direct contact with the housing cover. Since the inner part of the seal housing is composed of a material of poor thermal conductivity, e.g. stainless steel, the flow of heat transmitted by the hot housing cover to the seal housing that is to be kept cool is reduced in this embodiment. Better thermal decoupling of the seal housing from the housing cover is thereby achieved.

In order to introduce as little heat as possible into the seal housing, the housing cover is also manufactured from a material of poor thermal conductivity. It has been found to be particularly advantageous to manufacture the housing cover from a chemically resistant alloy steel. A steel of steel group number 45 has proven advantageous. However, other chemically resistant materials with poor thermal conductivity can also be used for this purpose.

In order to dissipate the heat as quickly as possible from the seal housing, the seal housing in a particularly advantageous embodiment of the invention has ribs with axial ducts formed therebetween. The ducts are preferably disposed in the outer part of the seal housing and are open toward the seal housing. The ducts can be milled into the seal housing. A less expensive production method is to manufacture the outer part of the housing as a casting with ribs or recesses for the ducts. In principle, it is also possible to form the ducts by attaching ribs to the seal housing. For this purpose, the ribs can be attached in a heat-conducting manner to the seal housing, either individually or in groups or in the form of a ribbed body. This can be accomplished by using shrink-fit joints, plug-in joints and other known techniques.

In order to dissipate the heat as quickly as possible from the seal housing, there is preferably a flow of air through the ducts. It has proven advantageous to position a fan impeller on a rotating part, in particular a coupling of the pump, said impeller delivering an air flow through the ducts. To ensure that the air also flows through the inner areas of the ducts, it has proven expedient to surround the seal housing on the outside with baffle plates. The baffle plates can be attached to the seal housing. They surround the seal housing in the form of a jacket and ensure that the stream of air flows uniformly through the cross sections of the individual ducts.

BRIEF DESCRIPTION OF THE DRAWINGS

The invention will be described in further detail hereinafter with reference to illustrative preferred embodiments depicted in the accompanying drawing figures, in which.

DETAILED DESCRIPTION OF PREFERRED EMBODIMENTS

Figure 1:
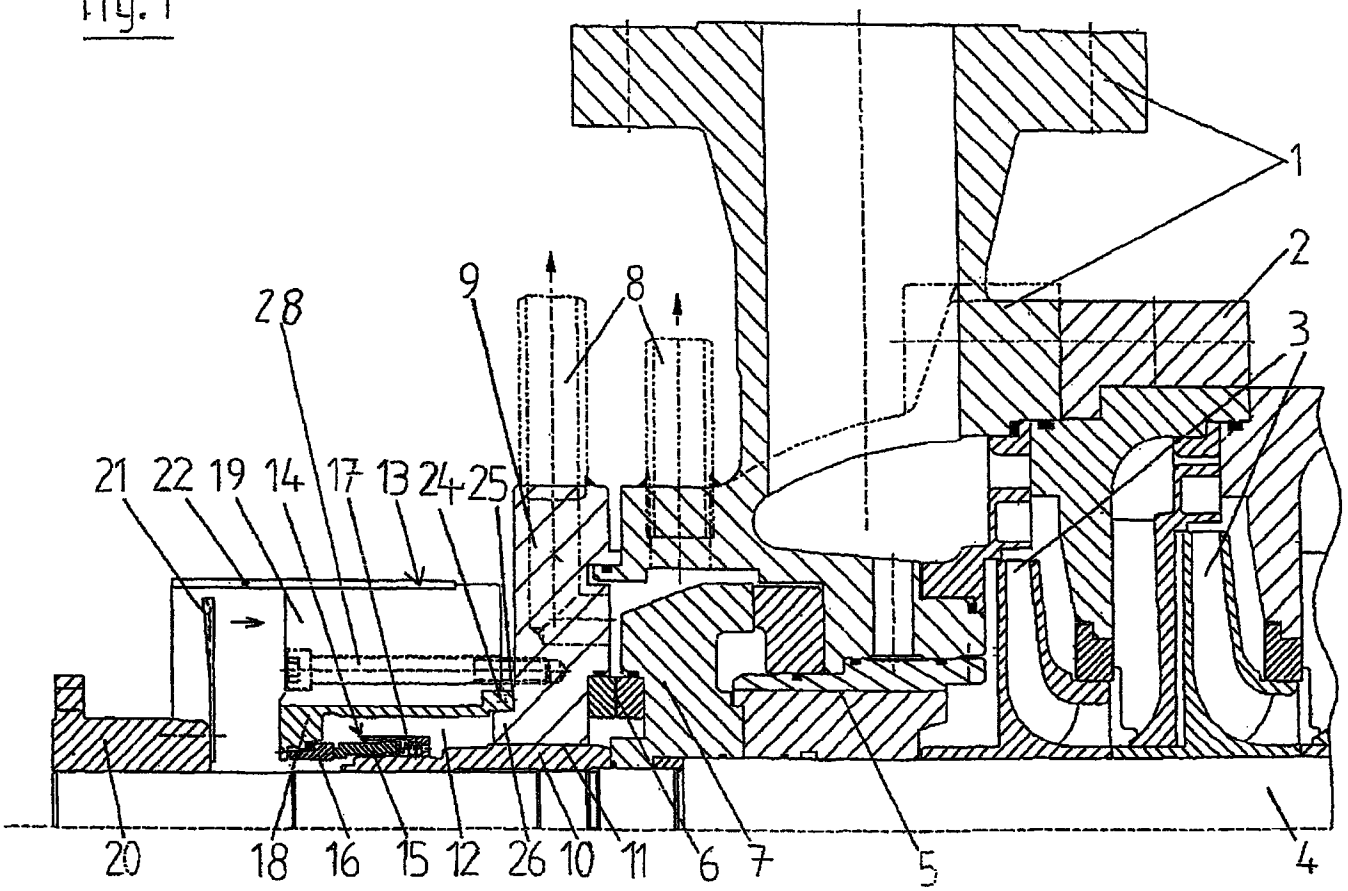
FIG. 1 shows a half section through the pressure-side end of the centrifugal pump.

FIG. 1 shows a section of a multi-stage centrifugal pump. The centrifugal pump comprises a pressure housing 1 and a stage housing 2. The impellers 3 are mounted on a shaft 4 and together form the rotor. This rotor is supported by radial bearings 5 and axial bearings 6. An axial thrust of the rotor is taken by a relief device 7. In principle, there are two different ways in which relief water flowing out from the latter can be discharged according to the invention. In the case of the first way, a return line 8 for the relief water runs through the pressure housing 1. In the second way, the return line 8 runs through the housing cover 9 which closes the pressure housing 1. The housing cover 9 adjoins the pressure housing 1 in a sealing manner.

An axial gap 11 is formed between the housing cover 9 and a shaft protection sleeve 10. The axial gap 11 acts as a restrictor for the delivered fluid in the pump housing and prevents relatively large quantities of delivered fluid from flowing into the chamber 12 of the seal housing 13.

A mechanical seal 14 is disposed within the seal housing 13. Mechanical seals belong to the category of contacting seals. The mechanical seal 14 consists of two low-wear rings. The sliding ring 15 revolves with the shaft 4 or with the shaft protection sleeve 10, while the mating ring 16 rests in a fixed manner on the seal housing 13. The sliding ring 15 and the mating ring 16 are pressed against each other by a spring 17.

The seal housing 13 is comprised of the inner part 18, which surrounds the mechanical seal 14, and an outer part 19. The outer part 19 is a bronze body. The inner part 18 is embodied as a stainless steel sleeve, which is shrunk-fit into the outer part 19. The stainless steel sleeve 18 is required to ensure corrosion resistance, while the bronze body 19 serves primarily for heat dissipation.

A fan impeller 21, which blows air over the seal housing 13, is mounted on a coupling 20 which connects the pump to a drive. The air flows through ducts situated between ribs on the outer part and dissipates the heat from the seal housing 13. For better guidance of the air, the outer part 19 of the seal housing 13 is surrounded by a baffle plate 22.

Figure 2:
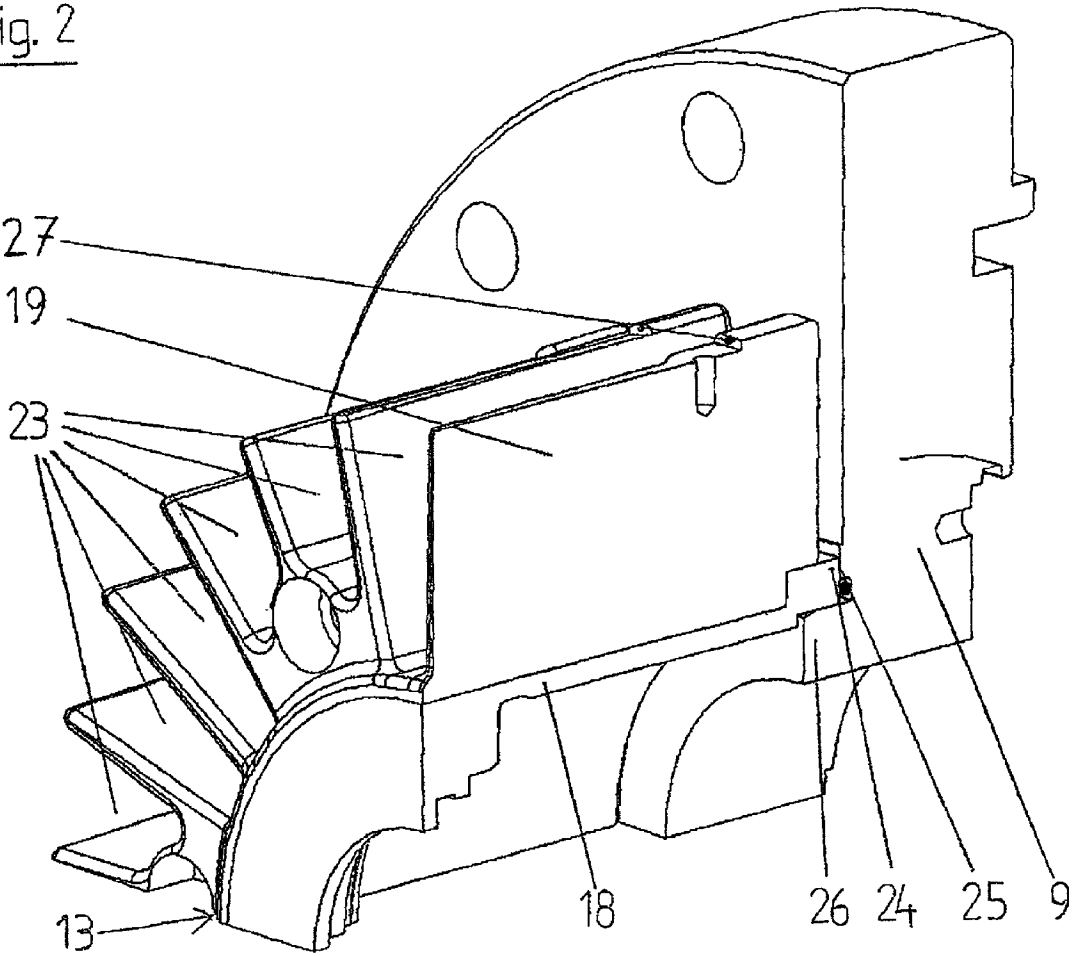
FIG. 2 shows a perspective view of the seal housing with the housing cover.

The axial ducts 23 in the outer part 19 of the seal housing 13 can be seen in the perspective view shown in FIG. 2. The ducts 23 are open toward the outer lateral surface of the seal housing 13. The fan impeller 21 blows air through the ducts 23. A baffle plate 22, which is not shown here for reasons of clarity (cf. FIG. 1), is made somewhat shorter than the length of the ducts 23. It rests against an offset 27 and improves guidance of the air in the ducts 23. Between the baffle plate ends at the offset 27 and the housing cover 9, the ducts are of open design and serve as an outlet opening for the cooling air flow. The baffle plate 22 ensures a forced flow of air through the inner areas of the ducts 23.

The seal housing 13 has a projection 24, which is formed by the inner part 18 of the seal housing 13. The surface 25 of the projection 24, which runs around vertically, serves as a contact surface of the seal housing 13 at the housing cover 9.

To center the seal housing 13 relative to the pump housing, the shaft 4 and the housing cover 9, the inner part 18 in this example is pushed with its projection 24 onto a smaller-diameter projection 26 of the housing cover 9. Connecting means 28 are used to hold the seal housing 13 and the pressure cover 9 together. The projection 26 of the housing cover 9 projects into the seal housing 13.

The foregoing description and examples have been set forth merely to illustrate the invention and are not intended to be limiting. Since modifications of the described embodiments incorporating the spirit and substance of the invention may occur to persons skilled in the art, the invention should be construed broadly to include all variations within the scope of the appended claims and equivalents thereof.

The invention claimed is:

1. A centrifugal pump for delivering hot fluids, comprising:

a contacting shaft seal disposed in a region of a shaft lead-through;

a seal housing for the shaft seal, and a return line for a partial flow of the delivered hot fluids, wherein no said delivered hot fluids is discharged from the seal housing;

a separate housing cover is disposed between the seal housing and a pump housing of the centrifugal pump;

a contact surface between the seal housing and the separate housing cover minimizes heat transfer;

a relief device for axial thrust provided upstream of the contacting shaft seal is configured to form a cavity between the relief device and the separate housing cover through which the partial flow of the delivered hot fluids passing the relief device are discharged via the return line;

the return line is separate from a hot fluids delivery outlet of the pump housing; and an end of the return line that receives the partial flow of the delivered hot fluids from the cavity is formed within at least one of the separate housing cover and an outer wall of the pump housing.

2. The pump as claimed in claim 1, wherein a gap between the housing cover and a rotating component restricts inflow of delivered fluid into the seal housing.

3. The pump as claimed in claim 1, wherein the seal housing has a projection, and a surface of the projection forms the contact surface on the housing cover.

4. The pump as claimed in claim 3, wherein the projection comprises a one-piece part in the form of a thermally insulating and centering connecting element disposed between the seal housing and the housing cover.

5. The pump as claimed in claim 3, wherein the seal housing comprises an inner part and an outer part, and the projection is formed by the inner part.

6. The pump as claimed in claim 1, wherein the housing cover has a projection, and the projection projects into the seal housing.

7. The pump as claimed in claim 6, wherein an insulating seal element is disposed on the projection between the housing cover and the seal housing.

8. The pump as claimed in claim 1, wherein an insulating seal element is disposed between the housing cover and the seal housing.

9. The pump as claimed in claim 1, wherein the seal housing comprises an inner part and an outer part; wherein said inner part is comprised of a different material than said outer part.

10. The pump as claimed in claim 9, wherein the outer part has a higher thermal conductivity than the inner part.

11. The pump as claimed in claim 9, wherein the inner part is manufactured from a more corrosion-resistant material than the outer part.

12. The pump as claimed in claim 9, wherein the outer part of the seal housing is provided with axial ducts.

13. The pump as claimed in claim 1, wherein the housing cover is manufactured of a chemically resistant alloy steel.

14. The pump as claimed in claim 1, wherein the seal housing is provided with axial ducts.

15. The pump as claimed in claim 14, wherein the axial ducts are open toward an outer lateral surface of the seal housing.

16. The pump as claimed in claim 1, wherein a fan impeller, which blows air through the seal housing, is positioned on a rotating part of the centrifugal pump.

17. The pump as claimed in claim 16, wherein said rotating part is a coupling.

18. The pump as claimed in claim 1, wherein the seal housing is surrounded by a baffle plate.

* * * * *